US005125854A

United States Patent [19]

Bassler et al.

[11] Patent Number: 5,125,854

[45] Date of Patent: Jun. 30, 1992

[54] MODULAR ELECTRICAL CONNECTOR

[75] Inventors: Maxwill P. Bassler, Hampshire; John E. Lopata, Naperville; Richard A. Nelson, Glen Ellyn, all of Ill.

[73] Assignee: Molex Incorporated, Lisle, Ill.

[21] Appl. No.: 730,767

[22] Filed: Jul. 16, 1991

[51] Int. Cl.[5] ..... H01R 13/648

[52] U.S. Cl. ..... 439/607; 439/701

[58] Field of Search ..... 439/607, 608, 599, 701, 439/63, 79, 745, 581, 578-585

[56] References Cited

U.S. PATENT DOCUMENTS

| | | | |
|---|---|---|---|
| 3,128,138 | 4/1964 | Noschese | 439/579 |
| 3,243,760 | 3/1966 | Dupre et al. | 439/579 |
| 3,825,874 | 7/1974 | Peverill | 439/579 |
| 4,605,269 | 8/1986 | Cohen et al. | 439/63 |

*Primary Examiner*—Larry I. Schwartz
*Assistant Examiner*—Hien D. Vu
*Attorney, Agent, or Firm*—Charles S. Cohen

[57] ABSTRACT

An electrical connector assembly disclosed which includes a shield and frame member wherein at least a portion thereof is conductive, a plurality of modular sub-assemblies with each module having a dielectric housing in which a plurality of terminals are mounted, and a conductive shield member is secured to conductive shielding of at least one shielded cable. Each terminal is electrically connected to a conductor contained within one of the at least one shielded cable. A latch mechanism is provided for removably securing each modular sub-assembly to the shield and frame member. An interconnection mechanism is also provided for electrically connecting the electrically conductive portion of the shield and frame member to the conductive shield member to complete the ground circuit between the conductive shielding of the shielded cable and the conductive portion of the shield and frame member.

15 Claims, 3 Drawing Sheets

MODULAR ELECTRICAL CONNECTOR

BACKGROUND OF THE INVENTION

The present invention relates generally to electrical connectors, and, more particularly, to a modular shielded electrical connector.

In the electronics industry, particularly the computer industry, it is extremely desirable to reduce the amount of space on the printed circuit board that is utilized by board mounted electrical connectors. The typical computer application utilizes a plurality of individual female electrical connectors mounted on a main printed circuit board and which project through a rear panel of the computer. Individual male connectors can be mated with the female connectors on the printed circuit board as required to achieve the desired configuration of the computer and its various electronic attachments.

As disclosed in co-pending patent application Ser. No. 711,229, assigned to the assignee of the present invention, a configuration for reducing the board space utilized by the electrical connectors involves offsetting the jack screws commonly used to secure mating electrical connectors. An additional configuration disclosed therein eliminates the jack screws positioned on the sides of the electrical connectors and replaces them with a latching mechanism located at the top of each connector.

The present invention further reduces the required space by eliminating some or all of the individual connectors located on the printed circuit board and replacing them with a single electrical connector. The individual male connectors that are mated with the female connectors in the prior art are replaced by a modular shielded electrical connector in which each of the male connectors is replaced by a modular sub-assembly that is secured to the shielded connector assembly. Modules can be added or removed from the connector assembly as desired in order to change the connections between the main printed circuit board and other components such as printers, terminals and the like.

SUMMARY OF THE INVENTION

An object, therefore, of the invention is to provide an improved shielded and modular electrical connector in which the components may be added and removed as desired to change the configuration of the electrical connections between the computer and the devices to which it is connected.

Accordingly, an electrical connector is provided having a molded dielectric frame member a shield and frame member wherein at least a portion thereof is conductive, a plurality of modular subassemblies with each module having a dielectric housing in which a plurality of terminals are mounted, and a conductive shield member is secured to conductive shielding of at least one shielded cable. Each terminal is electrically connected to a conductor contained within one of the at least one shielded cable. A latch mechanism is provided for removably securing each modular subassembly to the shield and frame member. An interconnection mechanism is also provided for electrically connecting the electrically conductive portion of the shield and frame member to the conductive shield member to complete the ground circuit between the conductive shielding of the shielded cable and the conductive portion of the shield and frame member.

These and other objects, features and advantages of the present invention will be clearly understood through a consideration of the following detailed description.

BRIEF DESCRIPTION OF THE DRAWINGS

In the course of this description, reference will be made to the attached drawings in which.

DETAILED DESCRIPTION OF THE PREFERRED EMBODIMENT

Figure 1:
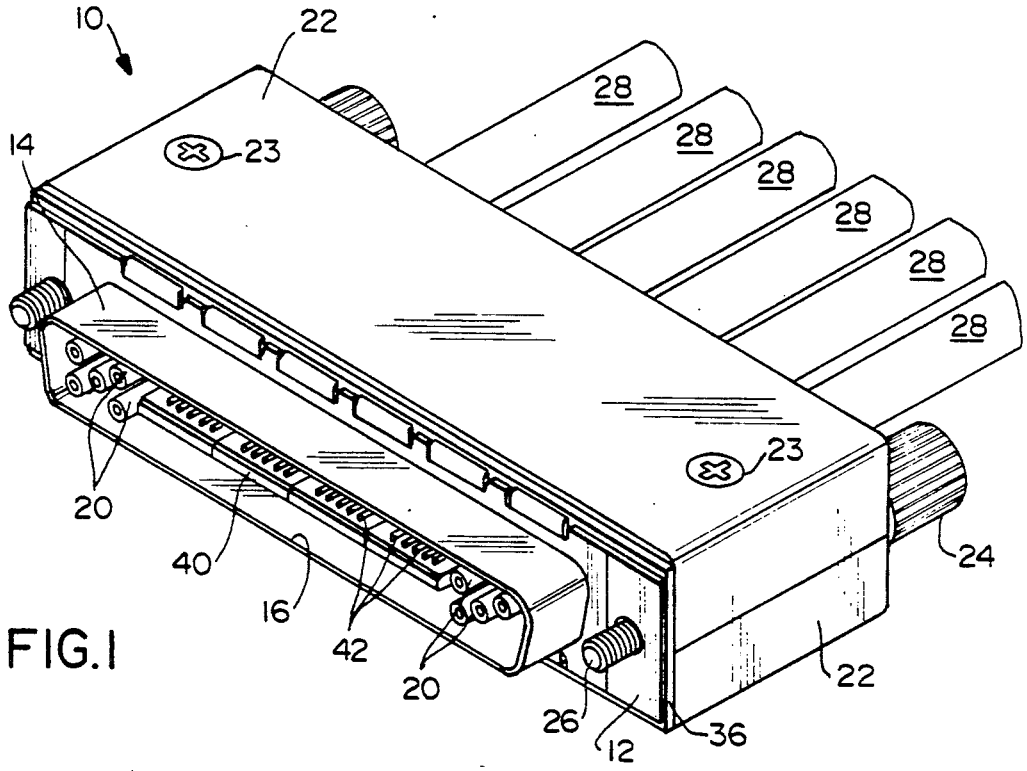
FIG. 1 is perspective view of the electrical connector embodying the present invention.
Figure 4:
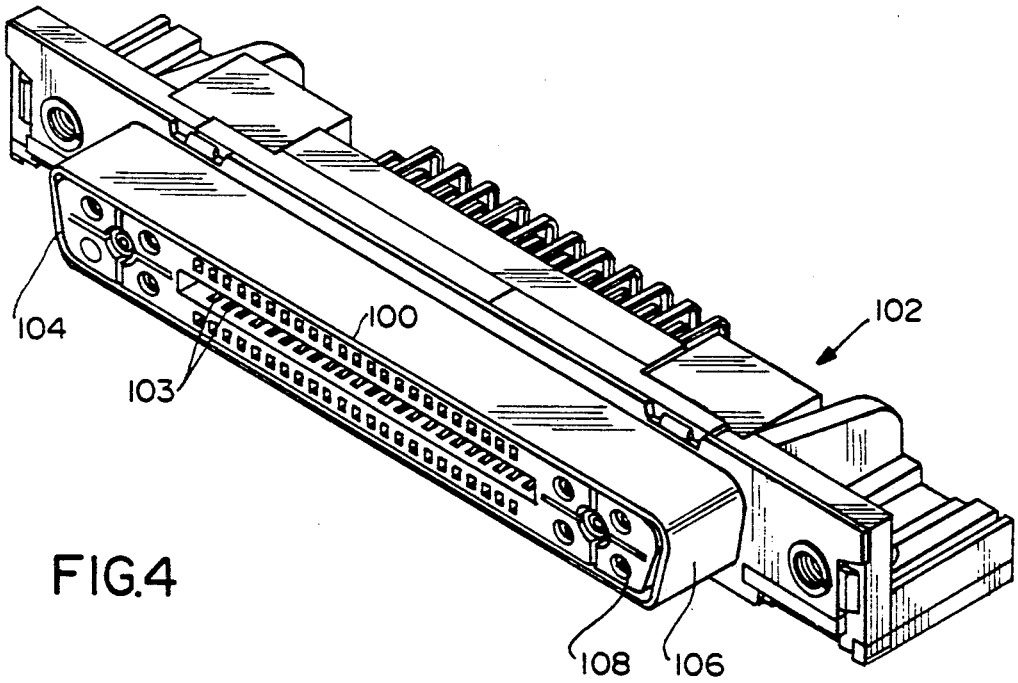
FIG. 4 is a perspective view of a connector with which the connector of FIG. 1 is mated.

Referring to FIG. 1, an electrical connector forming a representative embodiment of the invention is indicated generally at 10. More particularly, electrical connector 10 includes a stamped and formed metal shield 12 secured to a dielectric frame member 36. Shield 12 includes a shroud 14 which defines a receptacle 16 for receiving the mating portion 100 of a complimentary connector 102 (FIG. 4). In the preferred embodiment, a plurality of a leaf-type terminals 42 (FIGS. 1 and 3) are located in the center portion of receptacle 16 and cylindrical-type terminals 20 (FIG. 1) project outwardly at the two sides of the receptacle.

The electrical connector 10 includes a removable, two piece dielectric cover 22. It is anticipated that the cover 22 could also be made from a conductive material. The cover halves are secured together by fastening means such as, for example, screws 23 to permit the cover to be secured and removed from the connector as desired in order to change the configuration of the modular sub-assembly 30 contained within the connector as is further discussed below. Conventional jack screws 24 having a threaded end 26 project through shield 12 and frame member 36 for securing the electrical connector 10 to the mating connector 102 (FIG. 4). A plurality of cables 28 project rearwardly from electrical connector 10.

Figure 2:
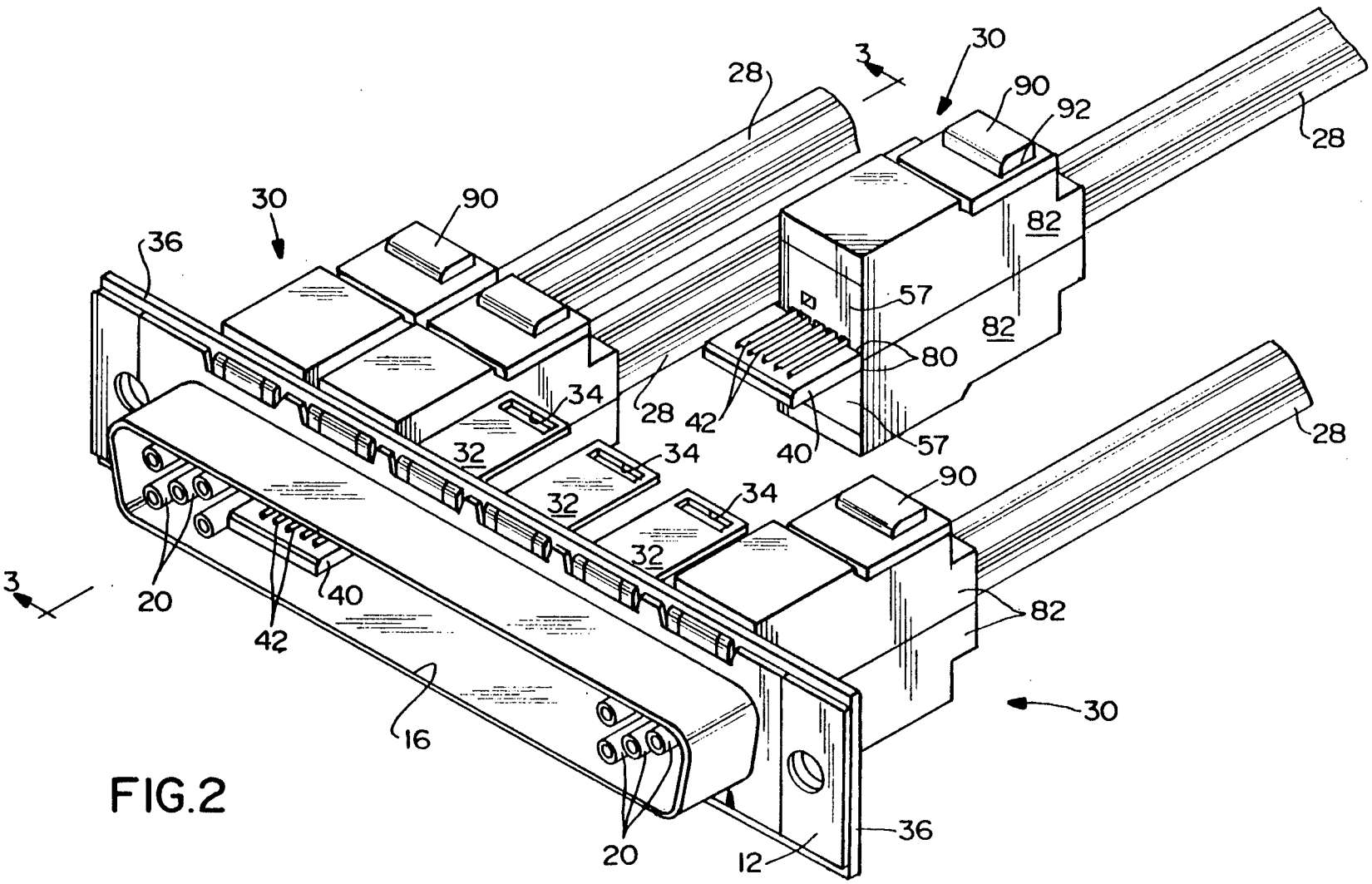
FIG. 2 is a partially exploded perspective view of the electrical connector of FIG. 1 with certain parts removed.
Figure 3:
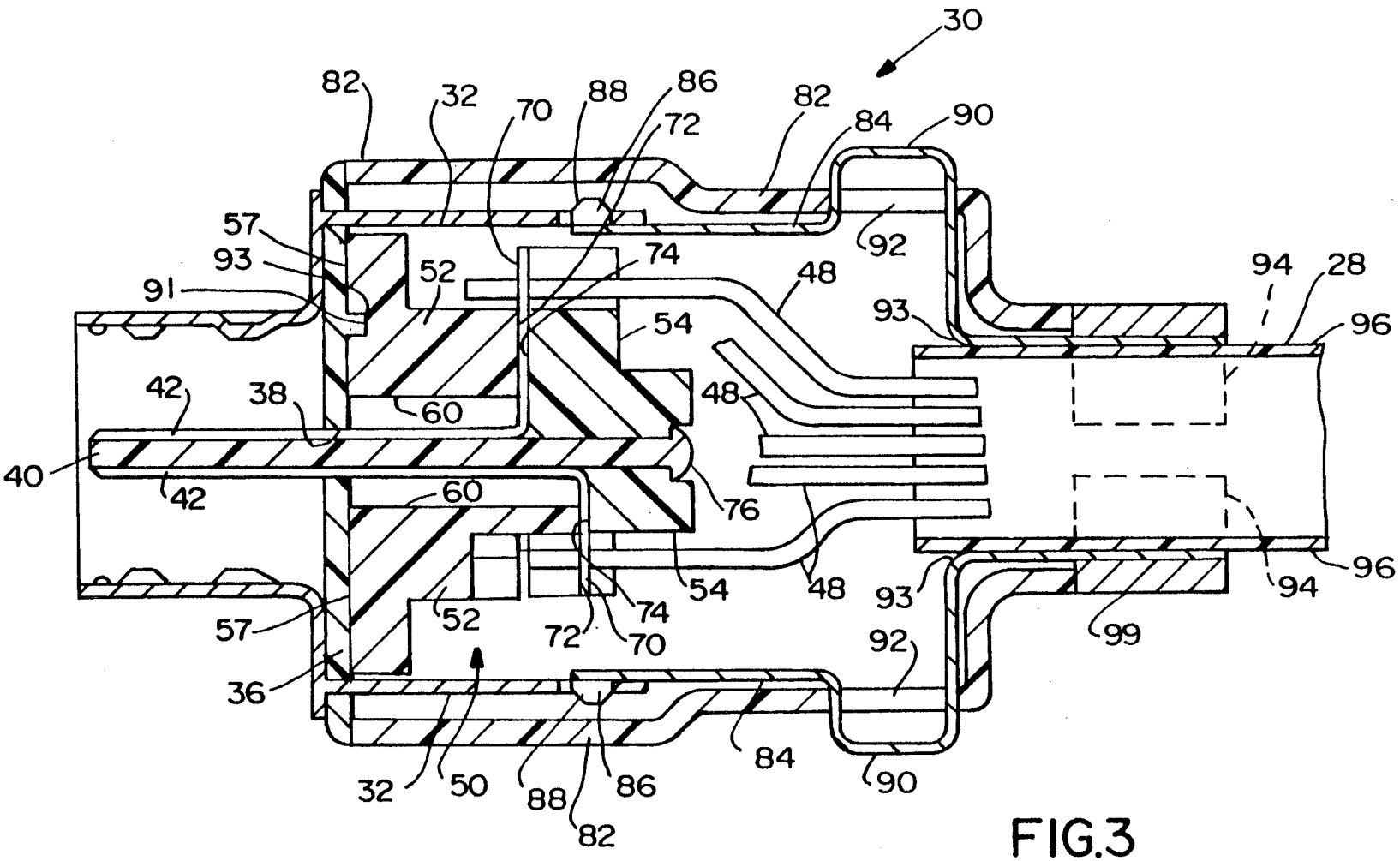
FIG. 3 is a vertical section taken generally along line 3—3 of FIG. 2.

As best seen in FIGS. 2 and 3, shield 12 includes a plurality of rearwardly projecting tabs 32 located along and extending from the top and bottom edges of the shield. Each tab 32 has a locking slot 34 located therein for securing the modular sub-assemblies 30. The shield 12 is mounted upon a dielectric frame member 36 which has an opening 38 through which a portion of projecting wall 40 and terminals 42 project (FIG. 3).

As shown in FIG. 2, connector 10 includes a plurality of modular sub-assemblies indicated generally at 30. Each sub-assembly includes its own multi-conductor cable 28 which extends rearwardly therefrom. The individual insulated conductors 48 contained within each cable 28 are terminated to individual insulation displacement terminals contained within a terminal and wire management block indicated generally at 50.

The terminal and wire management block 50 includes front and rear dielectric members 52 and 54 and a plurality of terminals 42. Front dielectric member 52 includes a projecting wall 40 that protrudes into the shroud portion 14 of shield 12 to support leaf-type terminals 42. The front member 52 also includes front walls 57 and a plurality of receptacles 60 on opposite sides of projecting wall 40 through which the terminals 42 project against opposite sides of the wall for engaging complimentary terminals 103 of a mating connector 100 (FIG. 4). An insulation displacement portion 70 of each terminal 42 is secured between the rear wall 72 of front member 52 and the front wall 74 of the rear dielectric member 54. This sandwiching of the insulation displacement portion 70 of each terminal 42 supports the terminal to prevent the insulation displacement portion from buckling when the terminal is terminated to an insulated conductor 48.

In assembly, the terminals 42 are inserted into the receptacles 60 in front member 52. Rear member 54 is then assembled to the front member 52 to sandwich and support the insulation displacement portions 70 of the terminals 42. A tab 76 on front member 52 is shown projecting through an opening in rear member 54 and heat staked in order to secure the front and rear members 52 and 54 together. The individual conductors 48 can then be individually forced into the insulation displacement portion 70 of the terminals as is known in the art to terminate each of the conductors to one of the terminals 42.

As best seen in FIG. 3, each modular sub-assembly 30 includes a dielectric housing comprised from a pair of hermaphroditic halves 82. These halves 82 can be assembled by known internal or external fastening methods (not shown). The housing halves 82 have slots 80 in their sidewalls and are dimensioned to securely receive the assembled terminal and wire management block 50 therein. Thus, once the block 50 and housing halves 82 are assembled, the modular sub-assembly 30 becomes a rigid structure.

Each modular sub-assembly 30 also includes a pair of upper and lower stamped and formed inner shield members 84 that also function as a latch mechanism. Beginning at the end closest the terminals 42, each shield member 84 includes a projection 86 for mating with slot 34 in tab 32 of the main shield. Projections 86 have a tapered leading end 88 so that the projections 86 are forced towards the center of the modular sub-assembly while the sub-assembly 30 is mated to tab 32. The projection 86 then snaps into the slot 34 of tab 32 to retain the modular sub-assembly 30 in place. A button portion 90 is stamped and formed in the inner shield member 84 and dimensioned so as to project through an opening 92 in modular sub-assembly 30. By pressing upon the top and bottom button portions 90, the front half of inner shield 84 is able to bend about point 93 which rotates projection 86 out of slot 34 in order to release the modular sub-assembly 30 from the frame member 36 and shield 12. Proceeding rearwardly from point 92, semicircular portions 94 are formed at the rear of inner shield 84 to surround and engage the braid 96 of cable 28, which has been exposed.

To assemble modular sub-assembly 30, a portion of the outer insulator (not shown) of cable 28 is stripped to expose the outer shielding braid 96. The individual insulated conductors 48 are then terminated to the terminals 42 contained within terminal and wire management block 50. The inner shield members 84 are loaded into the halves 82 of the modular sub-assembly 30. The block 50 together with the terminated terminals 42 is then loaded between the two halves 82 of the modular sub-assembly with the inner shield members 84 secured therein. The halves 82 are fastened together to create a modular sub-assembly 30. The semi-circular rear portion 94 of the inner shield wraps around the exposed braid 96 and a crimpable ferrule 99 is crimped over the semicircular portions 94 and the exposed braid 96 to complete the ground between inner shield 84 and the braid 96 as well as to provide a strain relief for the cable 28.

The modular sub-assemblies 30 can then be snapped onto tabs 32 in order to secure the modules to shield 12 in the desired order. This interconnects braid 96 with inner shield members 84 and shield 12 to complete the ground circuit. Once the desired configuration of modular sub-assemblies 30 is mounted to the shield 12 and frame 36, outer cover 22 is secured over the modular sub-assemblies to complete the connector 10.

By utilizing a plurality of modular sub-assemblies 30, a combination of terminals can be easily added or removed from the connector 10. The outer cover 22 is merely removed and the modules removed or added as desired. The cover is then replaced.

If desired, keying projections 91 can be added to frame member 36 and a mating receptacle 93 located in front wall 57 of front member 52. Such projections can also be utilized to provide polarization to ensure that the modular sub-assemblies 30 are not inserted upside down. An additional feature to ease assembly of the modular sub-assemblies 30 to shield 12 would be to provide color coding for the sequence of the modules. Different color markings could be provided on each tab 32 and modules 32 would either have similarly colored markings or the cover halves 82 could be molded of appropriately colored plastic.

In an instance in the prior art where a male connector would not have been mated to a female connector mounted on a printed circuit board, the present invention contemplates utilizing a "dummy" module (not shown) that would not have any electrical conductors or terminals secured thereto. If, at a later time, it is desired to remove the "dummy" module and replace it with a functional sub-assembly, such a conversion can easily be made. Similarly, an operational modular sub-assembly 30 can likewise be easily replaced by another operational sub-assembly or a "dummy" module with minimal effort.

In the embodiment shown, six or fewer modules can be secured to shield 12 and frame member 36. Of course the number of modules, the types of terminals contained within each modular sub-assembly 30 as well as the positioning of the modules can be altered provided that the mating connector 100 is similarly modified.

As is shown in FIGS. 1 and 2, the modular sub-assemblies 30 located on the two sides of the connector include cylindrical shaped terminals 20 that can be used for high-speed video transmissions keying or fiber optics, or any combination thereof. The center four sub-assemblies have leaf-type terminals of known type. As shown in FIG. 4, the array of cylindrical-shaped terminals adjacent side 106 includes a fiber optic connector 108 in order to provide additional flexibility in the connector assembly. In the array of cylindrical-shaped terminals adjacent side 104, one of the circular openings for receiving the terminals 20 is blocked to act as a keying mechanism. With such a configuration, the connector 10 would mate with the female connector 100 shown in FIG. 4. Such female connector would be mounted to a printed circuit board (not shown) and is substantially identical to that disclosed in co-pending application Ser. No. 711,231, which is hereby incorporated by reference. The principal difference between the connectors shown in application Ser. No. 711,231 and that of the present invention is that the connector of FIG. 4 includes the cylindrical shaped terminals 20 at both sides 104 and 106.

It will also be understood that the embodiments of the present invention which have been described herein are merely illustrative of an application of the principles of the invention. Numerous modifications may be made by those skilled in the art without departing from the spirit of the scope of the invention.

We claim:

1. An electrical connector assembly comprising:

a shield and frame member wherein at least a portion thereof is conductive;

a plurality of modular sub-assemblies, each module having a dielectric housing in which a plurality of terminals are mounted, and a conductive shield member secured to conductive shielding of at least one shielded cable, each said terminal being electrically connected to a conductor contained within one of said at least one shielded cable;

latch means for removably securing each said modular sub-assembly to said shield and frame member, said latch means mechanically and electrically directly engages and connects said conductive shield member and the conductive portion of said shield and frame member; and interconnection means for electrically connecting said electrically conductive portion of said shield and frame member to said conductive shield member to complete the ground circuit between the conductive shielding of said shielded cable and said conductive portion of said shield and frame member.

2. The electrical connector assembly of claim 1 wherein said shield and frame member includes a dielectric frame member having aperture means for receiving said plurality of modular sub-assemblies.

3. The electrical connector assembly of claim 1 wherein said conductive portion of said shield and frame member comprises a plurality of projections, said projections forming a part of said interconnection means and being received within said modules.

4. The electrical connector assembly of claim 1 further comprising in insulative cover surrounding said modular sub-assemblies when said sub-assemblies are secured to said shield and frame member.

5. The electrical connector assembly of claim 1 wherein said conductive portion of said shield and frame member comprises a plurality of projections, said projections forming a part of said interconnection means.

6. The electrical connector assembly of claim 5 wherein said conductive portion of said shield and frame member includes a stamped and formed metal component.

7. The electrical connector assembly of claim 5 further comprising an insulative cover surrounding said modular sub-assemblies when said sub-assemblies are secured to said shield and frame member.

8. A modular electrical connector comprising a plurality of terminal supporting modules, each said module being secured to a frame member to create an array of modules, said array defining a mating face of the connector for mating with another connector, wherein the improvement comprises:

a portion of said frame member being electrically conductive to provide shielding at said mating face;

each said module including a dielectric outer housing and a conductive shielding member secured to conductive shielding of a cable, said conductive shielding member comprising a pair of stamped and formed components, each stamped and formed component having a tail portion for contacting the conductive shielding of a shielded cable, and a mating portion for mating with a portion of said electrically conductive portion of said frame member, a portion of each stamped and formed member being located within said dielectric outer housing;

means for securing each said module to said frame member; and interconnection means for electrically connector said electrically conductive portion of said frame member to said conductive shield member to complete the ground circuit between conductive shielding of a shielded cable and said conductive portion of said frame member.

9. The modular electrical connector of claim 8 wherein said stamped and formed components further include a portion that projects through an opening in said cover to permit said mating portion to be unmated from said conductive portion of said frame means.

10. The modular electrical connector of claim 9 wherein said conductive portion of said frame means comprises a stamped and formed shield having a plurality of projections that project away from said face and mate with said mating portion to create an electrical connection between said shield, said stamped and formed components and the conductive shielding of a shielded cable.

11. The modular electrical connector of claim 10 further comprising an insulative cover member surrounding said modules when they are secured to said frame member.

12. The modular electrical connector of claim 11 wherein a first module contains a first type of terminals and a second module contains a second type of terminals.

13. An electrical connector assembly comprising:

a dielectric frame member having aperture means for receiving a plurality of modular terminal assemblies;

a first outer conductive shield member fixed to said frame member;

a plurality of modular sub-assemblies, each modular sub-assembly having a dielectric housing in which a plurality of terminals are mounted, and a second conductive shield member secured to conductive shielding of at least one shielded cable, said second conductive shield member including a pair of stamped and formed components, each stamped and formed component having a tail portion for contacting the conductive shielding of the shielded cable and a mating portion for mating with said first outer conductive shield member, each said terminal being electrically connected to a conductor contained within one of said at least one shielded cable;

means for securing each said modular sub-assembly to said shield and frame member; and interconnection means for electrically connecting said first outer conductive shield to said second conductive shield member to complete the ground circuit between the conductive shielding of said shielded cable and said first conductive shield member.

14. The electrical connector of claim 13 wherein said second conductive shield member further includes a button portion to permit said mating portion to be unmated from said first outer conductive shield member.

15. The modular electrical connector of claim 14 further comprising an insulative cover member surrounding said modular sub-assemblies when they are secured to said frame member.

* * * * *